US005372130A

United States Patent [19]

Stern et al.

[11] Patent Number: 5,372,130

[45] Date of Patent: Dec. 13, 1994

[54] FACE MASK ASSEMBLY AND METHOD HAVING A FAN AND REPLACEABLE FILTER

[75] Inventors: Donald J. Stern, Bellingham; James A. Tryon, Seattle, both of Wash.

[73] Assignee: DJS&T Limited Partnership, Bellingham, Wash.

[21] Appl. No.: 841,706

[22] Filed: Feb. 26, 1992

[51] Int. Cl.[5] ..... A62B 18/02; A62B 18/08; A62B 19/00

[52] U.S. Cl. ..... 128/205.25; 128/206.17; 128/207.11

[58] Field of Search ..... 128/201.25, 201.28, 128/205.25, 205.27, 205.29, 206.15, 206.17, 207.12, 206.12, 206.16, 206.19, 206.21, 207.11; 55/DIG. 33, 471

[56] References Cited

U.S. PATENT DOCUMENTS

| | | | |
|---|---|---|---|
| 3,525,334 | 8/1970 | Braman . | |
| 3,736,927 | 6/1973 | Misaqi . | |
| 4,090,510 | 5/1978 | Segersten . | |
| 4,320,755 | 3/1982 | Flint et al. . | |
| 4,331,141 | 5/1982 | Pokhis . | |
| 4,430,995 | 2/1984 | Hilton . | |
| 4,478,216 | 10/1984 | Dukowski . | |
| 4,502,480 | 3/1985 | Yamamoto . | |
| 4,549,542 | 10/1985 | Chien . | |
| 4,630,604 | 12/1986 | Montesi | 128/206.17 |
| 4,646,732 | 3/1987 | Chien . | |
| 4,866,056 | 12/1989 | Simpson . | |
| 4,971,052 | 11/1990 | Edwards . | |
| 5,003,974 | 4/1991 | Mou . | |
| 5,022,900 | 6/1991 | Bar Yona et al. . | |
| 5,154,168 | 10/1992 | Scholobohm | 128/205.27 |

FOREIGN PATENT DOCUMENTS

| | | | |
|---|---|---|---|
| 0094757 | 11/1983 | European Pat. Off. . | |
| 0130707 | 1/1985 | European Pat. Off. . | |
| 0241188 | 10/1987 | European Pat. Off. | 128/201.25 |
| 1285893 | 12/1968 | Germany . | |
| 222366 | 10/1924 | United Kingdom . | |
| 1049604 | 11/1966 | United Kingdom . | |
| 2044110 | 3/1979 | United Kingdom . | |
| 2109246 | 6/1983 | United Kingdom . | |
| 2173705 | 10/1986 | United Kingdom . | |
| 2209474 | 5/1989 | United Kingdom . | |
| 2215216 | 9/1989 | United Kingdom . | |
| 2215217 | 9/1989 | United Kingdom . | |
| 2222777A | 3/1990 | United Kingdom . | |

OTHER PUBLICATIONS

Advertisement "Light Weight Respirator Mask Has Self-Contained Blower" from Anon Mieux que le casque: l'Aerateur in Rravail et Securite (France), No. 1, Jan. 1963.

*Primary Examiner*—Kimberly L. Asher
*Attorney, Agent, or Firm*—Hughes, Multer & Schacht

[57] ABSTRACT

A face mask assembly and method of use having a housing and a replaceable filter mounted in said housing. A fan means draws air into a plenum chamber defined by said housing and said filter for this air to pass into a facial breathing area. An outlet check valve is provided, and a primary filter through which air passes before entering said plenum chamber.

39 Claims, 8 Drawing Sheets

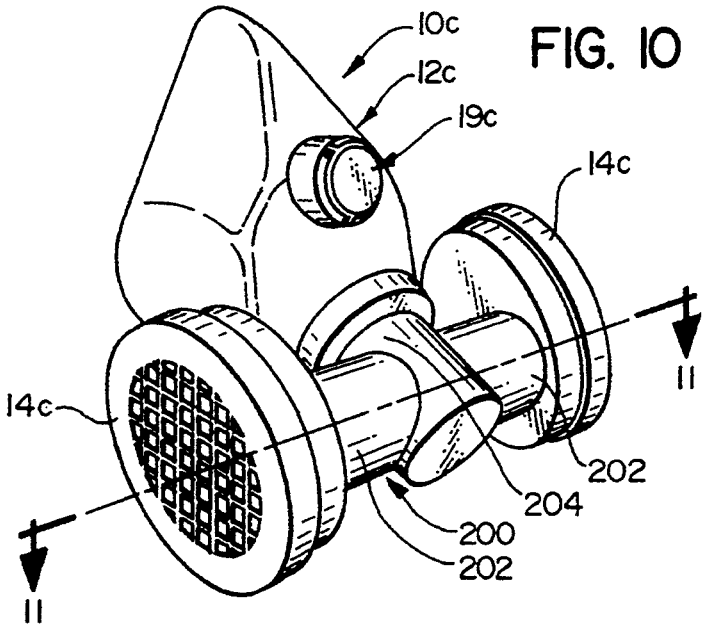
FIG. 10
FIG. 11
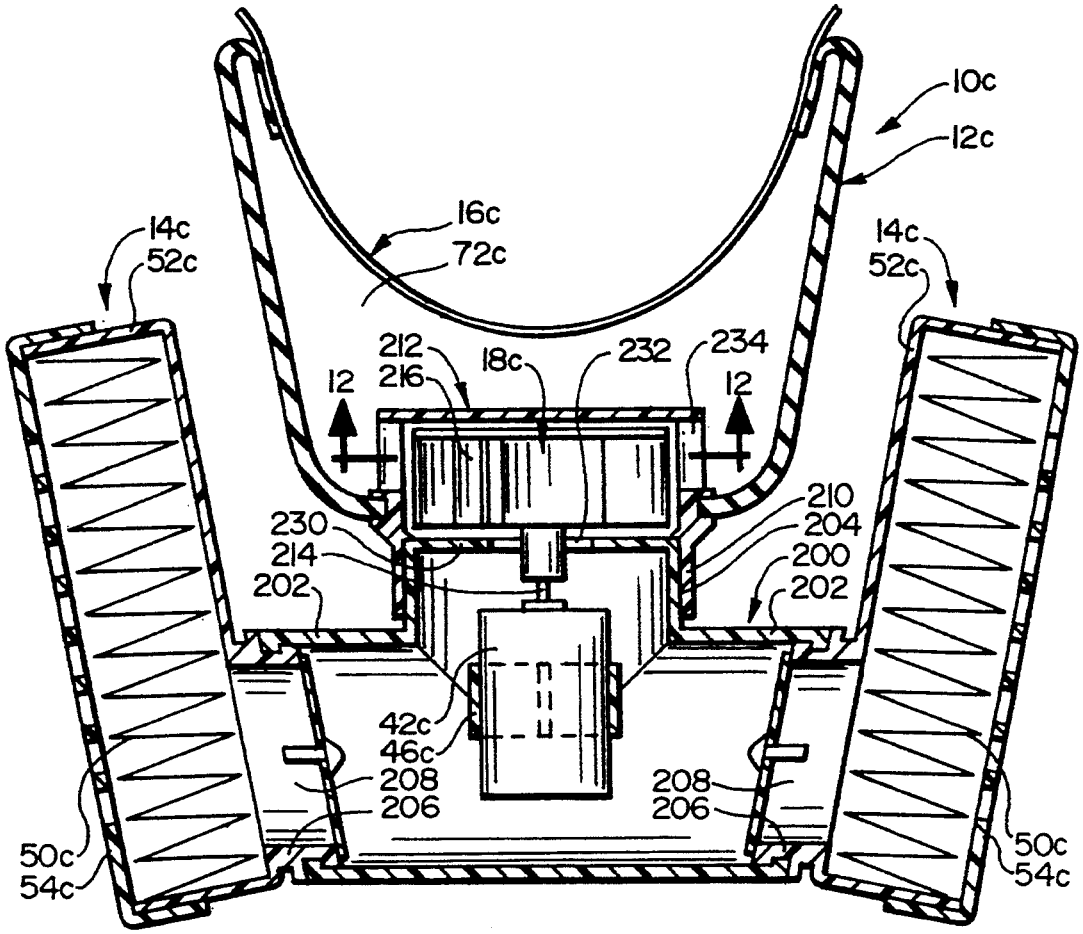

FACE MASK ASSEMBLY AND METHOD HAVING A FAN AND REPLACEABLE FILTER

BACKGROUND OF THE INVENTION

A. Field of the Invention

The present invention relates to a face mask assembly for a person, and more particularly to a face mask having a replaceable filter adjacent to a person's facial breathing area and also other features directed toward sanitary use of the face mask and comfortable and effective use of a face mask, and also to a method of using the same.

Background Art

The are many working environments in which it is necessary (or at least desirable) for a person to wear a face mask or other apparatus to filter the air which the person is breathing. In addition to the expected problems of arranging the filtering mechanism or other air purifying device so that it operates effectively, there are considerations relative to sanitation, ergometrics, convenience of use, and the person's comfort in allowing the breathing process to be as natural as possible. These problems or considerations are exacerbated to some extent when the mask is being worn in a situation where the person wearing the mask is doing active work that requires the person to breath air at a greater volumetric rate. For example, under these circumstances, in addition to being able to filter the air at a greater rate of volumetric flow, there may be greater condensation of moisture from the air which the person is exhaling. Also, many prior art face masks create a feeling of "stuffiness" or other type of discomfort, or some actual impediment to, or alteration of, the normal breathing process. Yet, in designing face masks to alleviate these problems, it is also desirable to make the face mask light weight, compact, economical in operation as well as manufacture, convenient to use, and also compatible with a variety of physical movements a person might be expected to perform in various tasks.

Another important consideration relates to sanitation, in that the same face mask may be worn by different persons at different times. Not just the breathing of the person, but possibly even the coughing or sneezing of the person wearing the mask could be a source of contamination that might be passed on to a person wearing the mask at a subsequent time. While ideally the face mask should be sanitized or sterilized in some manner before being worn by another, or possibly a procedure could be implemented where each person would have his or her own personalized mask which would not be used by another, such procedures may not be practical or properly adhered to. One general approach that is used in a variety of situations as a sanitation technique (e.g. a number of items used in hospital operations) is to simply make the item inexpensively and dispose of the item after its initial use. However, many items having more than a minimum of sophistication do not lend themselves to this approach.

A searching of prior art patents and literature has developed a number of items, these being listed below.

British patent specification 1,049,604 (Klavdienko) shows a "dustproof respirator" which comprises an airtight mask 1 made of an elastic material (e.g. rubber) that is held on a person's face by means of a tape 10. The mask 1 appears to comprise a planar wall having a folded elastic cuff 4 that is made integral with the mask 1 and extends around the perimeter thereof. An inlet valve 2 is formed apparently at the middle of the wall of the mask 1, and an outlet valve 3 is formed at a bottom part of the mask 1. It appears that the mask 1 defines substantially the entire enclosure which isolates a portion of the person's face from the ambient atmosphere. Extending forwardly from the mask 1 is what is called a "distance plate 8" having a rear portion adjacent to the inlet valve 2 and a forward portion. It is stated that the distance plate 8 is "a perforated easily bent distance plate 8", and it would appear to be formed as a cylinder, whose axes extends forwardly from the inlet valve 2. There is an outer coarse filter 5 within which is positioned an inner fine filter 6, these being closely adjacent to one another and having the shape of a cup. The perimeter portion of these filters 5 and 6 are connected to the cuff 4 of the mask, and the central portion of these filters 5 and 6 are positioned at the forward part of the distance plate 8. Thus, it appears that the mask 1 with the valves 2 and 3 define substantially all of the surface area and in turn defines the chamber or space that is directly adjacent to the person's face and breathing area, while the two filter elements 5 and 6 are positioned outside of the chamber defined by the mask 1. It is stated that the inner fine filter 6 is changeable. In operation, outside air passes first through the coarse filter 5, and then through the inner filter 6 and thence into the inlet valve 2 so as to pass into the chamber defined by the mask 1 so that this air can be breathed in by the person. (It may be that the air actually passes through the perforated distance plate 8 before passing into the inlet valve 2). Then when the person exhales, the exhaled air passes from the chamber defined by the mask 1 out the valve 3.

U.S. Pat. No. 4,090,510 (Segersten) discloses a "Face Mask With a Changeable Filter". The mask 1 is made of leather or the like and has a number of holes which are punched out to admit air. The filter is made of two layers, namely a layer or sheet 7 made of a suitable cellulose to intercept coarse particles and a similar piece 8 to intercept fine particles. To form the filter, the sheet 8 is placed on the sheet 7 and then the sheet or filter 7 is folded over with the seam 9 made so that the filter has an outside part 7 and an inside part 8. This resulting filter is joined to the mask 1 by means of two metal bands 11 fitting on the side of the mask 1.

U.S. Pat. No. 4,866,056 (Simpson) discloses a "breathing apparatus where there is a mask 2 that is called an 'orinasal mask'. This mask 2 has an inhale valve 8 and an exhale valve positioned on the opposite side of the mask 2, but not shown. There is a pressure sensing element 9 which responds to the person exhaling, and when the person exhales, a fan which draws air into the mask is shut off.

U.S. Pat. No. 5,022,900 (Bar-Yona et al) shows a particular configuration of a ventilation filtration device. There is a centrifugal type rotor and the filter extends at least in an annular configuration up along side the rotor.

U.S. Pat. No. 5,003,974 (Mou) shows an emergency breathing mask which is transparent and is placed over the user's head. There is a flexible air pipe feeding air into the transparent container from a case 2.

U.S. Pat. No. 4,971,052 (Edwards) shows a motor driven fan which draws air through a filter 16. The motor is controlled by a switch means that responds to pressure variations as the user breathes.

U.S. Pat. No. 4,549,542 (Chien) shows a breathing mask in which a motor drives a series of fans. One set of blades directs the air into the breathing area and a second set sucks the air from the breathing space. There may be a filter section 22 that filters the air that is drawn in.

U.S. Pat. No. 4,502,480 (Yamaoto) shows a breathing aid for motorcycle riders in which there is a hose that carries air from a filter placed on the front of the bike. There may be a filter element in the fan as shown in FIG. 2.

U.S. Pat. No. 4,478,216 (Dukowski) shows a breathing filter with a face mask. There is a fan which propels air through the filter.

U.S. Pat. No. 4,430,995 (Hilton) shows a filtering breathing mask in which there is a fan means that supplies air to a resilient air storage bag 13.

U.S. Pat. No. 4,331,141 (Pokhis) shows a breathing arrangement where there is a deformable container on the person's thorax so that when the person breathes in so that the volume of the thorax increases, the container is deformed and the volume of the inner chamber decreases so that ambient air which enters the inner chamber of the container is urged to flow through the filter system.

U.S. Pat. No. 4,320,755 (Flint et al) shows a breathing mask filter system in which a fan 10 drives the air through a filtering element 13. Patentability seems to be directed toward specific mechanical features.

U.S. Pat. No. 3,736,927 (Misaqi) shows a breathing aid in which a motor powered fan blows filtered and conditioned air between the user's face and the shield.

U.S. Pat. No. 3,525,334 (Braman et al) shows a clean-room suit in which there is an air supply means 51 that includes a fan to supply air to the user. There is a filter element that filters the air as it leaves the suit so that the dust and like are removed from the exhaled air.

U.S. Pat. No. 4,646,732 (Chien) shows a respiratory mask where there is a fan 4*b* for drawing air through what appears to be a filter in a canister 8, and delivers this air through the passageway 43 into the interior of the mask. There is an exhaust fan 6*b* that draws the air from the interior of the mask and discharges it outwardly through an exhaust vent 61*c*.

British Pat. No. 222 366 (Davis) relates to "gas mask and particularly to masks commonly known as double mask" (first page, column 1, line 60 and following). The inner mask a covers the nose and mouth to form a gas-tight joint, and it has inlet valves k1 that lead from the space h between the inner mask a and outer mask b into the area within the inner mask. There is an outlet valve leading from inside the inner mask to the outside atmosphere. The person exhales from the inner mask a through the tube m and out a check valve 1. The incoming air enters from a source or supply through the tube j and thence through the openings n into the area h. It is stated (page 2, column 1, line 62) that the inner mask is connected at c by cement. It does not appear that this inner mask a functions as a filter since air enters the inner mask area by valves k1.

British Pat. No. 2,044,110 (Gdulla) shows a respiratory mask rather similar in overall design to the aforementioned to Davis British Patent (No. 222,366). the inhaled air passes upwardly through the tube 1 and through the valve 11 into the inner mask 10. The exhaled air goes through a check valve 14 leading downwardly from the inner mask and also extending through the outer mask.

German Pat. No. 1,285,893 which has a removeable inner mask, but the inner mask is not in the form of a secondary filter.

British Pat. No. 2,173,705 (Howie) discloses a mask having a filter where there is a fan that draws the air through the filter. It is arranged so that the fan 9 can be interposed between the filter and the mask inlet, or the filter may be connected directly to the mask.

British Pat. No. 2,222,777A (Simpson) is another example of a filter for a respiratory device that has a motor driven fan drawing air into the filter.

British Pat. No. 2,215,217 (Simpson) shows a pressure filter respirator similar to the other Simpson patent (British 2,222,777A) where there is a motor driven fan. There is a curved wall 10 within the mask to direct the air into an upper portion of the face mask.

British Pat. No. 2,109,246 (Shyn et al) is yet another example of a mask having a motor to drive a compressor to draw the air through the filter.

British Pat. No. 2,215,216 (Simpson) shows a mask similar to that shown in the other Simpson Patent (British Pat. #2,215,217A), but in the '216 patent there is shown an alarm system to indicate when the pressure within the mask has declined to too low of a level.

British Pat. No. 2,209,474A shows a respirator where there is a fan that draws air through a filter unit 10 having a replaceable filter 11.

European patent application no. 0,130,707 (O'Connor) shows a breathing apparatus where there is a fan drawing air through a filter cannister 11 and directing it through a hose 4 to a mask. The mask has an inner mask with an inlet valve and an outlet valve.

European Patent application no. 0,094,757 (O'Connor) shows a pressure respirator substantially the same as that shown in European Patent 0,130,707. This patent focuses more on the concept of having the inlet valve arranged so that when the person is exhaling, even though the fan continues to operate, there is substantially no air moved into the mask.

Finally, there is shown one page of an advertisement entitled "Light weight respirator mask has self-contained blower".

SUMMARY OF THE INVENTION

The face mask assembly of the present invention is designed to be worn by a person over a facial breathing area of the person.

This face mask assembly comprises a main housing and a replaceable filter removably mounted to the housing so that with the assembly being worn by the person, the filter is positioned to define with the person's facial breathing area an air breathing region from which the person inhales air and into which the person exhales air. The filter is arranged to have outside air pass therethrough into said air breathing region to be inhaled.

The filter is arranged so that with the assembly being worn by the person, the filter substantially encloses the air breathing region and isolates the air breathing region from the assembly. Thus, if the mask assembly is to be worn by another, the filter can be replaced with another filter to remove contaminations that might have collected on the first used filter.

The housing and the filter define at least partially an intermediate plenum chamber from which air flows through said filter into said air breathing region. There is fan means arranged to draw ambient air into the plenum chamber to flow through the filter.

Also, the preferred version, the assembly comprises an outer filter through which outside air is moved by the fan means to flow into the plenum chamber. In the preferred form, the fan means draws the outside air to the outer filter and then moves the outside air into the plenum chamber.

Also, in the preferred configuration, the assembly comprises outlet check valve means which communicates with the air breathing region to discharge exhaled air from the air breathing region, and to prevent outside air from passing pass through said valve means into said air breathing region. The valve means comprises a valve element means and a valve mounting structure. The valve mounting structure engages at least a portion of the replaceable filter so as to function to position the replaceable filter relative to the main housing to provide the plenum chamber.

Also, in the preferred configuration, the valve mounting structure defines a passageway by-passing said inner filter and leading from said air breathing region through said valve element means to an area outside the mask assembly.

Further, in the preferred configuration, the replaceable filter has a perimeter portion positioned within a perimeter portion of the main housing, with a perimeter portion of the replaceable filter being positioned against the person's facial area with the mask assembly in its use position being worn by the person. The valve mounting structure is positioned within the perimeter portion of the housing and spaced therefrom, with the valve mounting structure and the perimeter portion of the main housing providing locating support for the replaceable filter to define the plenum chamber.

A portion of the outlet check valve means which is exposed directly to the air breathing region is removable mounted in the main housing so as to be readily removable from said face mask assembly.

In one embodiment, the fan means comprises a rotor having impellor blade means which directs the air radially outwardly into guide vanes.

Other features will become apparent from the following detailed description.

BRIEF DESCRIPTION OF THE DRAWINGS

FIG. 10 is an isometric view of a second embodiment of the present invention;

FIG. 11 is a cross-sectional view taken along line 11—11 of FIG. 10.

DESCRIPTION OF THE PREFERRED EMBODIMENTS

Figure 1:
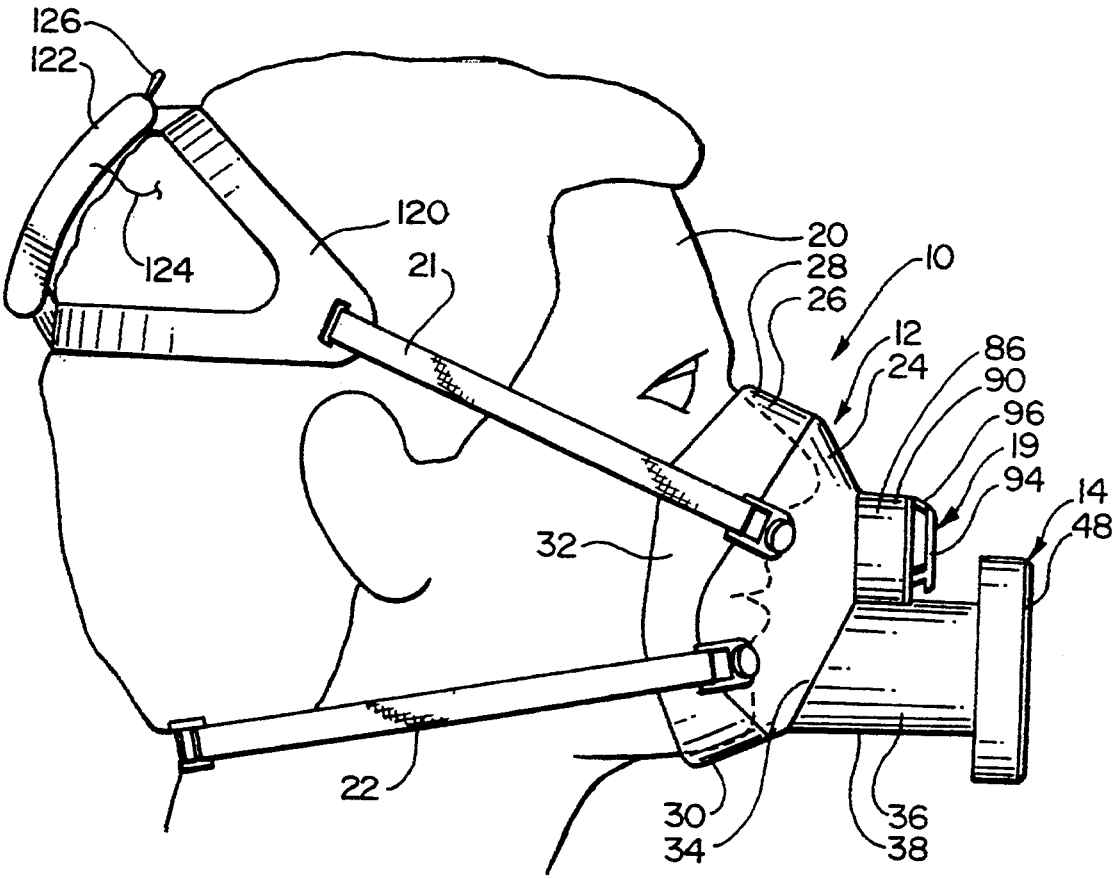
FIG. 1 is a side elevational view of a first embodiment of the mask assembly of the present invention being worn by a person in its use position.
Figure 2:
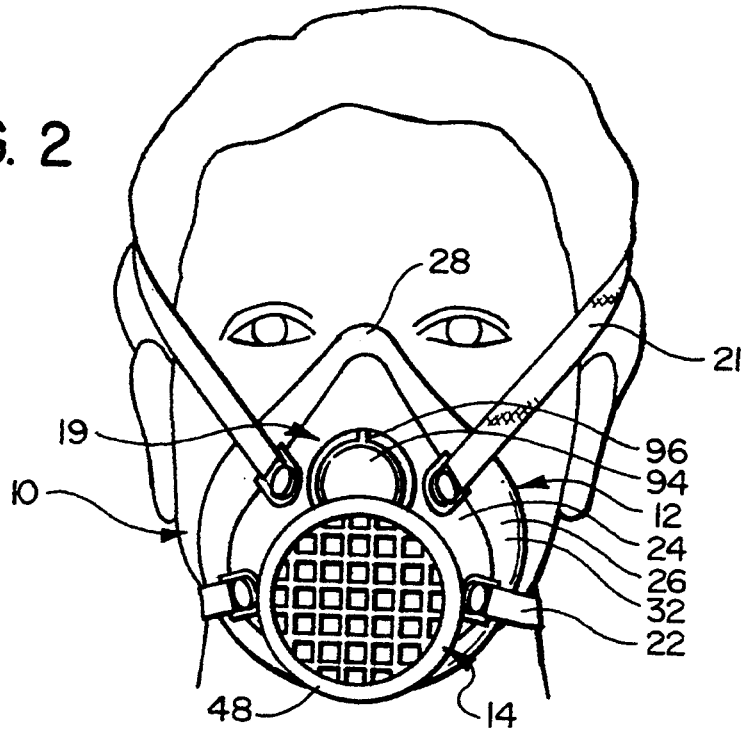
FIG. 2 is a front elevational view of the first embodiment of the present invention being worn as shown in FIG. 1.
Figure 3:
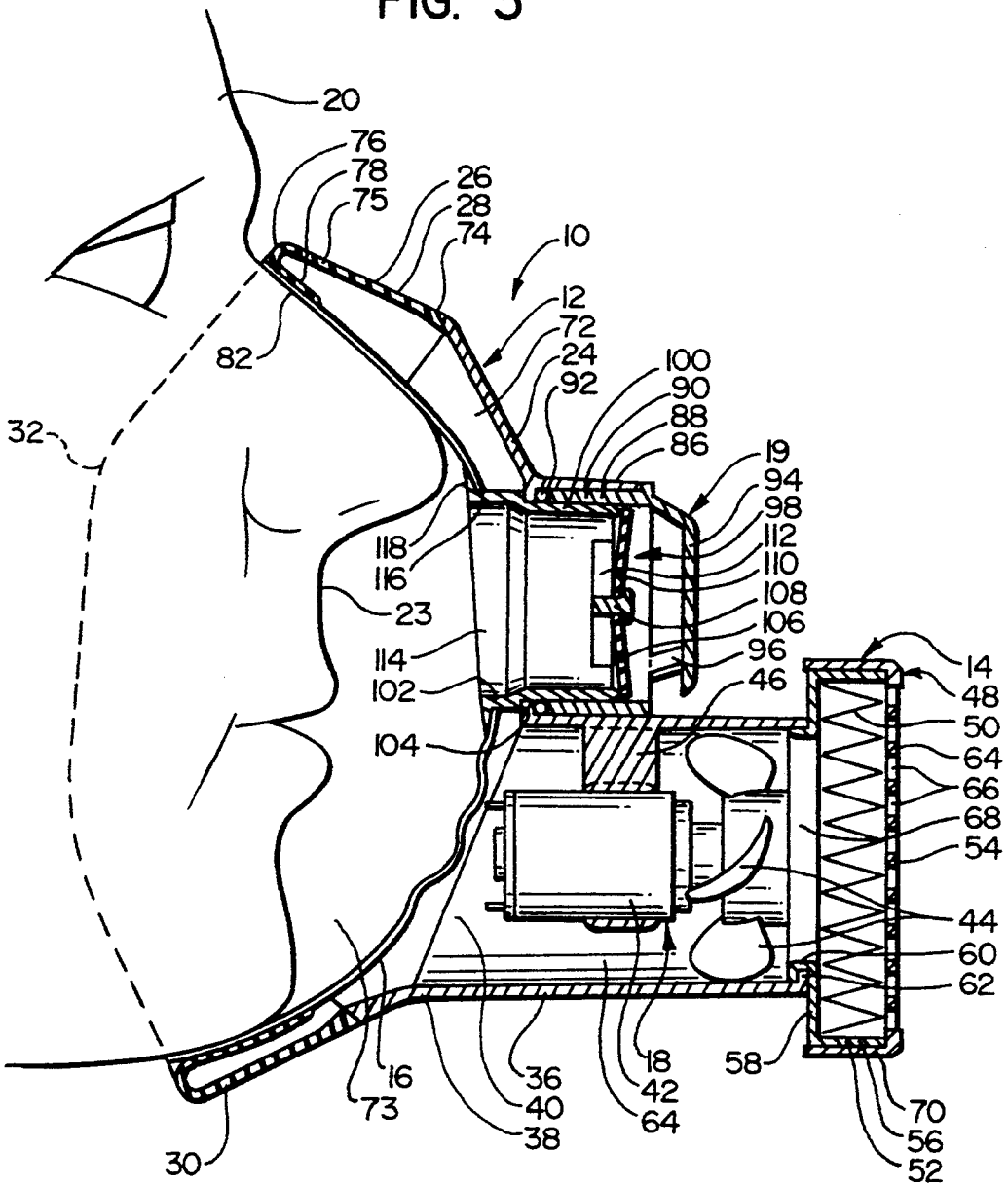
FIG. 3 is a view similar to FIG. 1, drawn to an enlarged scale, and showing the first embodiment of the mask assembly of the present invention in section taken along a vertical center plane extending in a forward to rear direction.

The face mask assembly 10 of the first embodiment of the present invention is shown in FIGS. 1–5 and comprises a main housing 12, an outer or primary filter 14, an inner replaceable filter 16, a fan 18 positioned in a flow path between the outer and inner filters 14 and 16, and an air outlet or exhaust assembly 19. The mask 10 is adapted to be mounted directly to the person's head 20, this conveniently being accomplished by a pair of upper and lower mounting straps 21 and 22 that attach on opposite sides of the housing 12 and reach around the back of the person's head and neck. The mask 10 covers the facial breathing area 23 of the person, and this facial breathing area 23 can be considered to be the surface area of the person around the person's nostrils and mouth.

To describe the mask more particularly, the housing 12 comprises a main central portion 24 and an outer perimeter portion 26. The main central portion 24 is made of a more rigid plastic material and has in a front elevational view a generally triangular configuration having a rounded base, with the rounded apex of the triangle beginning at the person's nose (when the mask assembly 10 is being worn) and the two sides of the triangle extending downwardly and divergently to approximately the location of the person's mouth, and with the lower portion extending down around the person's chin in a curve. The peripheral wall portion 26 is made of a more yielding rubber-like material, and the inner forward edge of this peripheral portion 26 is bonded to the outer perimeter edge of the main housing portion 24 and extends outwardly and rearwardly therefrom in a configuration to conform to the person's face and lower chin around the facial breathing area 23. More particularly, an upper part 28 of the wall portion 26 matches the configuration of the person's nose so as to extend on opposite sides of a person's nose. The lower part 30 of the wall portion 26 is positioned against the lower part of the person's chin and contoured in a curve to fit closely adjacent thereto, while the side parts 32 of the wall portion 26 are positioned adjacent to the person's cheeks on opposite sides of the person's mouth.

The aforementioned outer filter 14 and fan 18 are positioned at the lower middle part 34 of the main housing portion 24. More particularly, there is formed integrally with the main housing portion 24 a forwardly and horizontally extending cylindrically shaped fan housing 36, the rear end 38 of which is positioned at an inlet opening 40 formed in the lower middle part 34 of the main housing 24.

Mounted within the fan housing 36 is the fan 18, this comprising a battery powered motor 42 and the fan elements or blades 44 that are rotated by the motor 42. The motor 42 is supported by a mounting strut 46 that can be made of a shock absorbing material and is connected to the fan housing 36.

Mounted to the forward end of the fan housing 36 is the aforementioned primary filter 14. This primary filter 14 comprises a primary filter housing 48 having the overall configuration of a shallow cylinder, and also a primary filter element itself 50 that is positioned within the housing 48. The housing 48 is made of two sections, namely a containing section 52 and a closure cap or plate 54. The section 52 has an outer perimeter wall 56 having the shape of the shallow cylinder, and the rear edge of this perimeter wall 56 is fixedly connected to (or formed integrally with) a radially inwardly extending annular flange 58 that reaches in a short distance to terminate in a lip 60 that connects removably by means of a snap fit to the forward edge 62 of the fan housing 36. The aforementioned closure cap or plate 54 comprises a main plate member 64 having a generally circular configuration and having a plurality of through openings 66 through which ambient air flows to pass through the filter 50 and through the front opening 68 of the fan housing 36. The closure plate section 52 also comprises a mounting collar 70 formed integrally with the plate 64 and fitting around the perimeter wall 52 in a snap fit or a friction fit.

Air that is drawn by the fan 18 through the primary filter 14 passes through the rear fan housing opening 40 into an intermediate region or plenum chamber 72 defined by the aforementioned inner filter 16 and the main housing 12, and thence through the inner filter 16 into an inner space or region 73 defined mostly by the inner filter 16 and the person's facial breathing area 23. To describe this arrangement more particularly, the perimeter wall section 26 of the main housing 12 has a forward edge 74 which is connected to the outer edge of the main housing 24, from which the wall section 26 extends outwardly and rearwardly as an outer wall portion 75 to then curve inwardly in an approximately 180 curve at 76 and then extend forwardly and inwardly in the form of a flange 78. This flange 78 is spaced inwardly from the outer wall portion 75 of the perimeter wall 26 by approximately one eighth to one quarter of an inch, and is approximately half an inch to an inch in width. This flange 78 extends entirely around the perimeter of the mask assembly 10 and serves as a mounting flange to locate the perimeter portion 82 of the inner filter 16 so that the inner filter 16 is properly spaced from the main housing 12 to form the plenum 72 between the housing 12 and filter 14, and also press this perimeter portion 82 against the person's skin surface. (As will be described later herein, the exhaust valve assembly 19 serves a similar locating function relative to the middle part of the inner filter 16.) The overall shape of the inner filter 16 corresponds generally to that of the main housing 12 but is spaced therefrom an adequate distance to form the aforementioned chamber 72.

Mounted at the centerline of the main housing portion 24 is the aforementioned exhaust assembly 19 through which the air exhaled by the person is discharged. This exhaust assembly 19 comprises an outer cylindrical housing 86 formed integrally with the main housing portion 24 and extending forwardly therefrom. Positioned within the cylindrical housing 86 is a second housing section 88 having a cylindrical mounting portion 90 which fits snugly within the aforementioned housing section 86. A seal ring 92 is positioned at the rear edge of the mounting portion 90 within the housing section 86 so as to form a seal between the members 86 and 90. The housing section 88 also comprises a forward protective plate portion 94 attached to the forward edge of the cylindrical portion 90 by means of a plurality of struts 96 that permit air to pass outwardly by and around the protective plate portion 94.

There is a valve section, generally designated 98, and this section 98 comprises a stepped cylindrical portion 100, the forward portion of which fits removably within the aforementioned cylindrical portion 90. The rear portion 102 of this portion 100 is cylindrically shaped and has a slightly larger diameter than the portion 100 so as to be stepped outwardly therefrom, thus forming a positioning shoulder 104 by which the member 100 is located within the cylindrical portion 90.

Mounted to the forward end of the member 100 is a check valve 106 which of itself may be of conventional design. More particularly, this check valve 106 comprises a central mounting stud 108 to which the flexible valve element 110 is mounted. The valve element 110 seats against the forward edge of the cylindrical member 100 to stop reverse flow, and also bears against radial support arm 112 for the stud 108. When the person exhales, the person's breath passes directly into the rear opening 114 defined by the member 100, and the valve element 110 deflects forwardly away from the forward edge of the cylindrical member 100 to permit the outward flow of the person's breath through the exhaust valve 98.

As indicated previously, the insert 100 also serves another function, which is to properly locate the central portion of the inner filter 16. More particularly, the middle portion of the inner filter is formed with a through opening 116, and the filter edge defining this opening 116 fits over a radially outwardly extending lip 118 that is formed at the rear edge of the stepped portion 102.

It will be noted in FIG. 1 that the upper straps 21 connect to opposite ends of a flexible mounting element 120 that fits around the upper back portion of the person's head 20. This mounting element 120 provides one or more pockets to mount one or more batteries 122 which supply power to the fan motor 42. Only a portion 24 of one wire from the battery or batteries 122 is indicated in FIG. 1, and it is to be understood that the wire or wires leading from the battery or batteries 122 to the motor 42 can be arranged in a number if ways. Also, an on/off switch is indicated at 126 at the location of the batteries 122 to control the flow of current to the motor 42. This switch 126 also could be at some other location.

Figure 4:
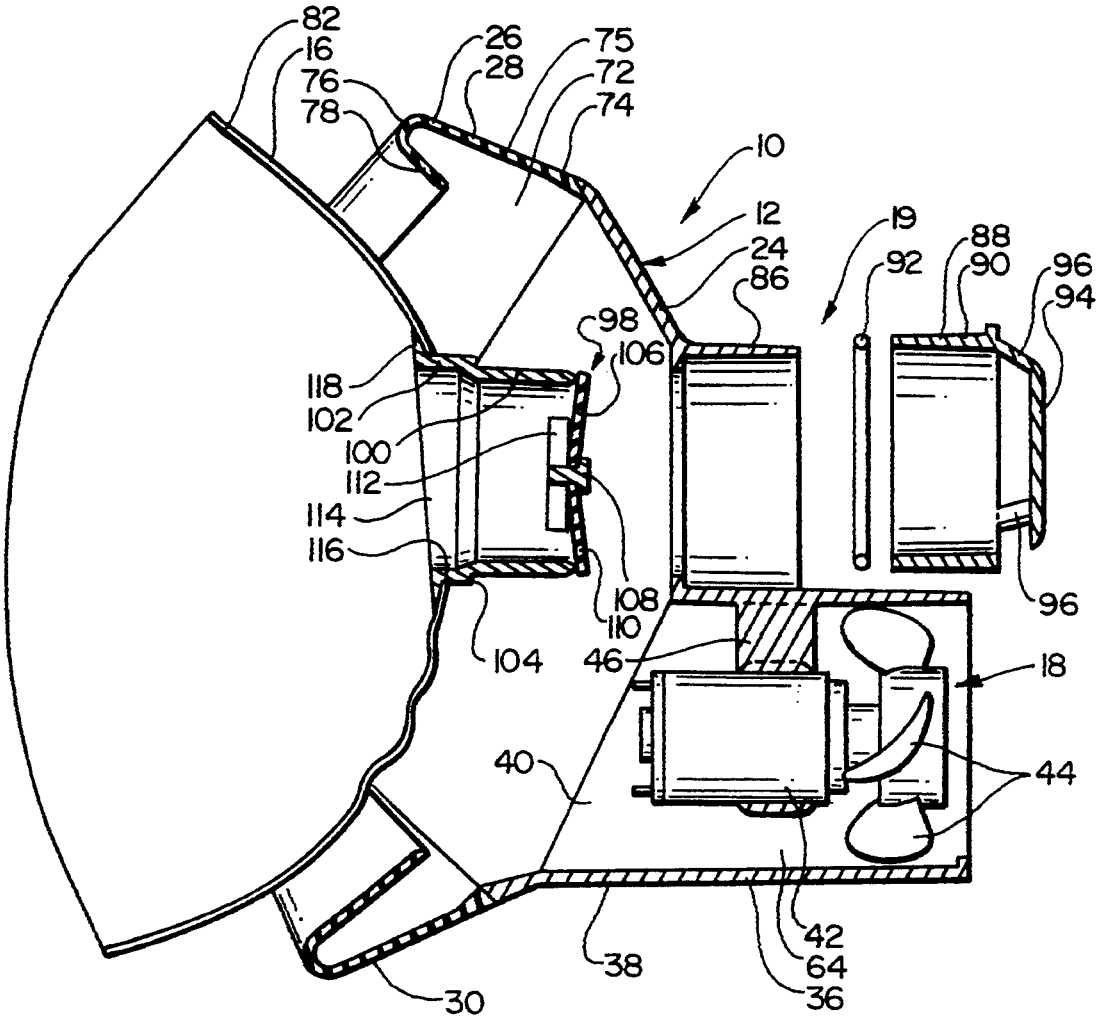
FIG. 4 is a sectional view of the first embodiment similar to FIG. 3, showing some of the components separated from one another.
Figure 5:
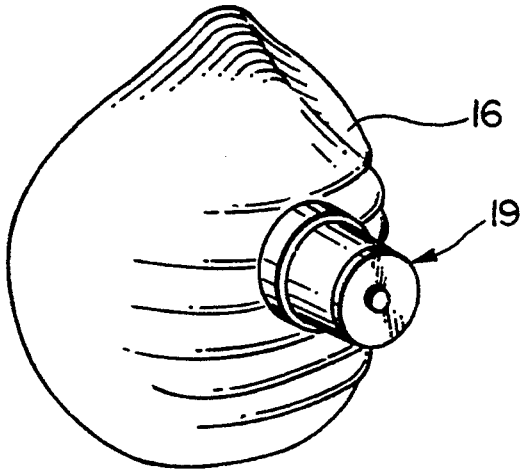
FIG. 5 is an isometric view of the replaceable inner filter and outlet valve of the first embodiment.

As can be seen in FIGS. 4 and 5, the valve section 98 comprises the cylindrical mounting member 100 with the check valve 106 mounted thereto can be preattached directly to the inner filter 16 to provide a replaceable unit made up of the inner filter 16 and the valve section 98. It will be noted that with the mask 10 in its assembled position, the only components which are in contact with or directly exposed to the person's facial area 23 are the inner filter 16 and the check valve section 98. Thus, when it is desired to have, for example, different people wear the same mask 10, for sanitary considerations, it is a simple matter to simply replace the filter 16 with the removeable valve section 98 mounted thereto from the main housing 12 and replace this with another filter 16 and valve section 98. The inner filter 16 is made of, for example, cotton, wool, a synthetic material or combinations thereof. For example, it could be made of material comparable to that used in the 3M No. 8500 filter mask. Desirably, this inner filter 16 is formed simply and inexpensively so that it is practical to replace this inner filter 16 with reasonable frequency. The outer filter 14 can be made of a variety of materials, this depending to some extent on the working environment in which the mask assembly 10 is being used. For example, the types of filter material used for the filter 14 could be the materials used in various commercially available filter cartridges.

To describe the operation of the present invention, let it be assumed that the mask 10 is in its fully assembled position, with the fan 18 installed and operating, the outer filter element 50 in place, and a replaceable inner filter 16 and valve section 98 in their installed position within the mask housing 12. The person simply places the assembled mask 10 against the person's lower face area so that the mask 10 encloses the facial breathing area 23 of the person. The mounting straps 21 and 22 are positioned around the person's head and tightened to the desirable degree so that the mask is held firmly against the person's face. It will be noted that the peripheral edge portion 82 of the inner filter 16 is positioned between the flange 78 of the perimeter wall housing portion 26 and the person's face. Accordingly, the only portion of the mask 10 to be in direct contact with the person's face is the perimeter portion 82 of the inner filter 16.

The on/off switch 126 is turned on to start the fan 18 operating. The fan 18 draws air inwardly through the perforate plate portion 64 of the cap 54, through the outer filter element 50, thence through the fan 18, and through the opening 40 into the intermediate region or plenum chamber 72. The air in the plenum chamber 72 passes through the inner filter 16 to be breathed in by the person.

When the person is inhaling, the pressure differential between the chamber 72 and that at the inner space or chamber 73 causes the air in the intermediate chamber 72 to pass through the inner filter 16 into the space 73 to be breathed in by the person. At this time, the exhaust valve section 98 is closed so that all of the air drawn inside the inner filter 16 passes first through the outer filter 14 and also through the inner filter 16. The size, power and other operating characteristics of the fan 18 are selected relative to the impedance to air flow provided by the outer filter 14 and the inner filter 16, so that when the person is breathing in, air is flowing through the inner filter 16 into the inner space 73 at an adequate pressure to approximate the normal ambient conditions where a person is inhaling during a normal breathing cycle.

When the person begins to exhale the pressure in the space 73, within the inner filter 16, being exposed directly to the air that the person is exhaling, rises slightly so that the exhaust check valve element 100 opens so that there is a flow of air from the person's mouth and/or nose directly through the exhaust valve section 98.

Overall, the components affecting the flow of air are balanced in a manner so that the pressure and flow of air on both the breathing in and breathing out of the person approximate rather closely actual breathing conditions as if no mask were being used.

A significant feature of the present invention is that as the person exhales, all of the exhaled air flowing directly from the person's mouth or nose is contained substantially entirely by the inner filter and caused to flow through exhaust valve section 98. Depending upon a number of conditions, such as ambient temperature and humidity, the volume of air which the person is inhaling and exhaling, and possibly the characteristics of the person, there will often be a certain amount of moisture in the air that the person is exhaling. Any tendency for this moisture to condense on the inner filter 16 is counteracted by the inflow of fresh outside air through the inner filter 16 and into the facial breathing area, and with the exhaled air passing essentially outwardly through the exhaust valve sect ion 98.

As indicated earlier herein, it may be that after one person uses the mask assembly 10, this same mask assembly is to be worn by a second person. If so, the second person can simply remove the previously used inner filter 16 and valve section 98 and replace both of these with a fresh inner filter 16 and valve section 98. This would substantially alleviate the potential problem of sources of contamination from the person previously wearing the mask assembly 10 from being transmitted to the subsequent user.

There are other advantages to the arrangement of the present invention. It will be noted that the stepped mounting cylinder 100 serves a number of functions. First, it cooperates with the opening 116 of the inner filter 16 in two ways. The stepped portion 102 and lip 118 engage the filter edge around the filter opening 116 to provide a convenient means for holding the inner filter 16 in the proper position. Also, the mounting cylinder 100 provides a breath exhaust passageway in a manner that the opening 116 in the inner filter remains aligned and in proper communication with the outlet check valve 56. Further, while providing these other functions, the mounting cylinder 100 isolates the intermediate chamber 72 from the inner region adjacent the person's facial breathing area 23. This overall arrangement uniquely solves the problem of providing the replaceable inner filter 16 as the main operating interface directly contiguous to the facial breathing area 23, while still providing for the discharge opening for the exhaust air that by-passes both the inner filter 16 and the outer filter 14. Then by also making the valve section 98 as a removeable item (and replaceable item if needed), this enables the potential areas of contamination for the subsequent user to be removed, as described previously herein. Then the valve section 98 could be either replaced, or sanitized and reused.

Figure 6:
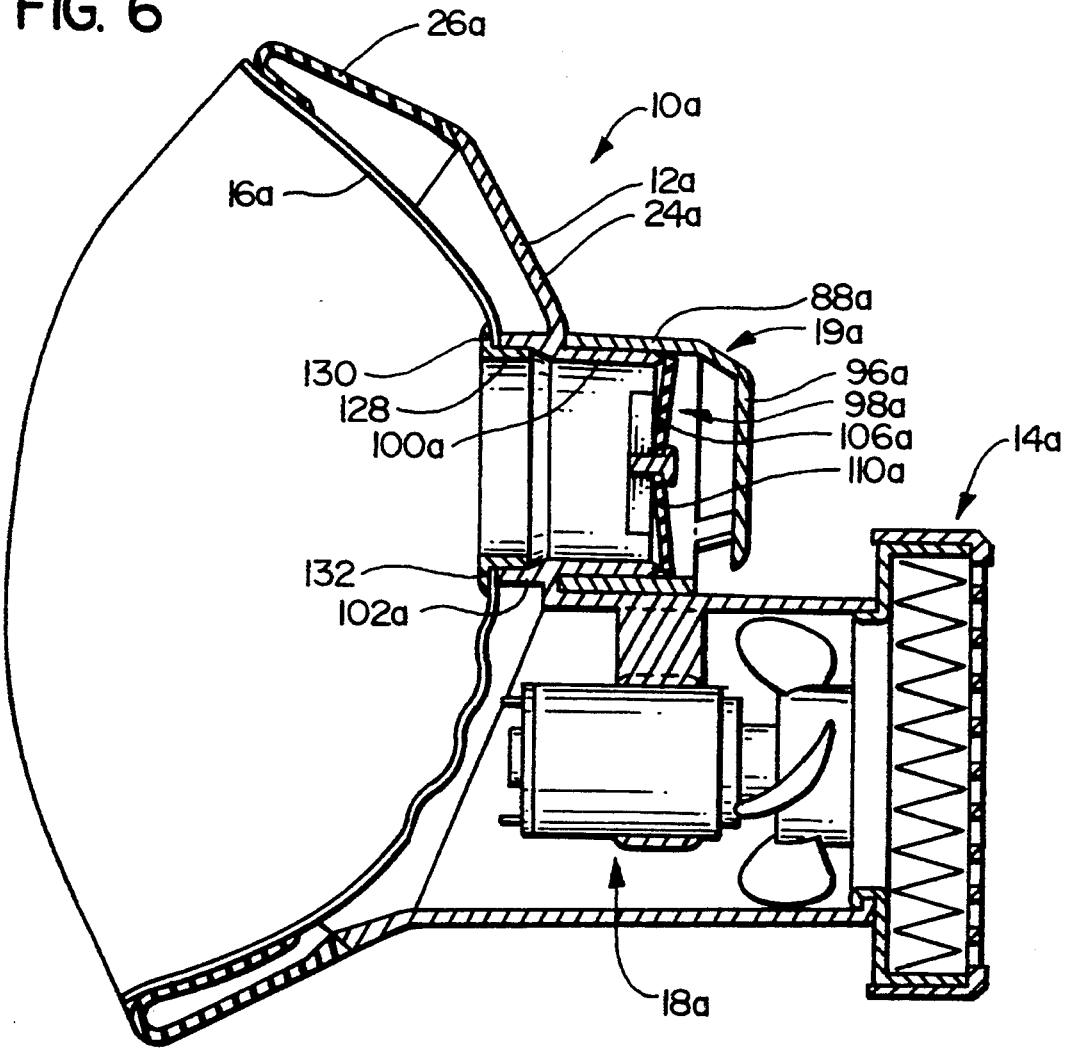
FIG. 6 is a sectional view of a second embodiment of the present invention, taken along a vertical forward to rear plane, as in FIG. 3 relative to the first embodiment.
Figure 7:
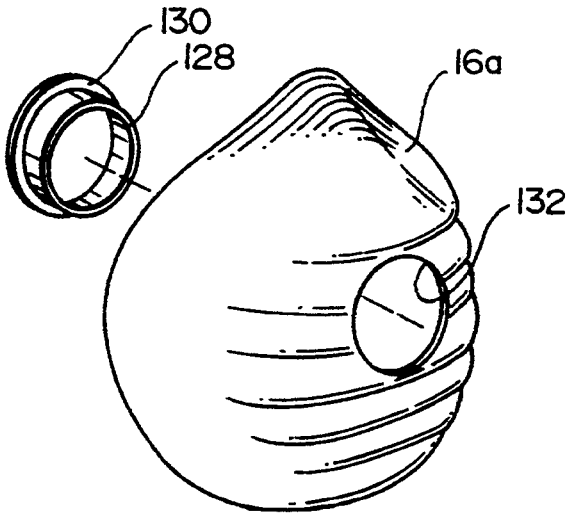
FIG. 7 is an isometric view similar to FIG. 5, showing the replaceable inner filter of the second embodiment with its retaining collar spaced therefrom.

A second embodiment of the present invention is shown in FIGS. 6 and 7. Components of this second embodiment which are similar to components of the first embodiment will be given like numerical designations, with an "a" suffix distinguishing those of the second embodiment.

Thus, there is a mask **10*a* which comprises a main housing 12*a*, made up of the main housing portion 24*a* and the perimeter wall portion 26*a*. Also, there is a fan 18*a* and a primary filter 14*a*. Further, the inner filter 16*a* has in general the same overall configuration as the inner filter 16** of the first embodiment.

This second embodiment shown in FIGS. 6 and 7 differs from the first embodiment of FIGS. 1 through 5 in that the exhaust assembly **19*a* is made somewhat differently. As in the first embodiment, there is a mounting cylinder 86*a* which carries a forward protective plate 96*a*. This cylinder 86*a* fits around a cylindrical member 100*a*, but the rear end portion of the member 100*a* is formed integrally with the main housing portion 24*a*. The valve element 110*a* is mounted directly to this member 100*a*. The rear cylindrical portion 102*a* is formed integrally with the member 100*a* and integrally with the housing portion 12*a*, and this portion 102*a* receives therein a mounting collar 128 which fits within the cylindrical portion 102*a*. Further, this mounting collar 128 has a radially outwardly extending retaining lip 130 which fits against an inner edge 132 that forms the center opening of the inner filter 16***a*. It can be seen in FIG. 6, that with the mounting collar 128 in place, the edge 132 that forms the central opening of the inner filter 16*a* is held in place by the lip 130 pressing the filter opening edge portion 128 against the rear edge against the cylindrical portion 102*a*.

In this second embodiment, while the inner filter 16*a* is replaceable, the valve section 98*a* cannot be readily replaced as in the first embodiment. In other respects, the second embodiment of FIGS. 6 and 7 is substantially similar to the embodiment shown in FIGS. 1 through 5.

Figure 8:
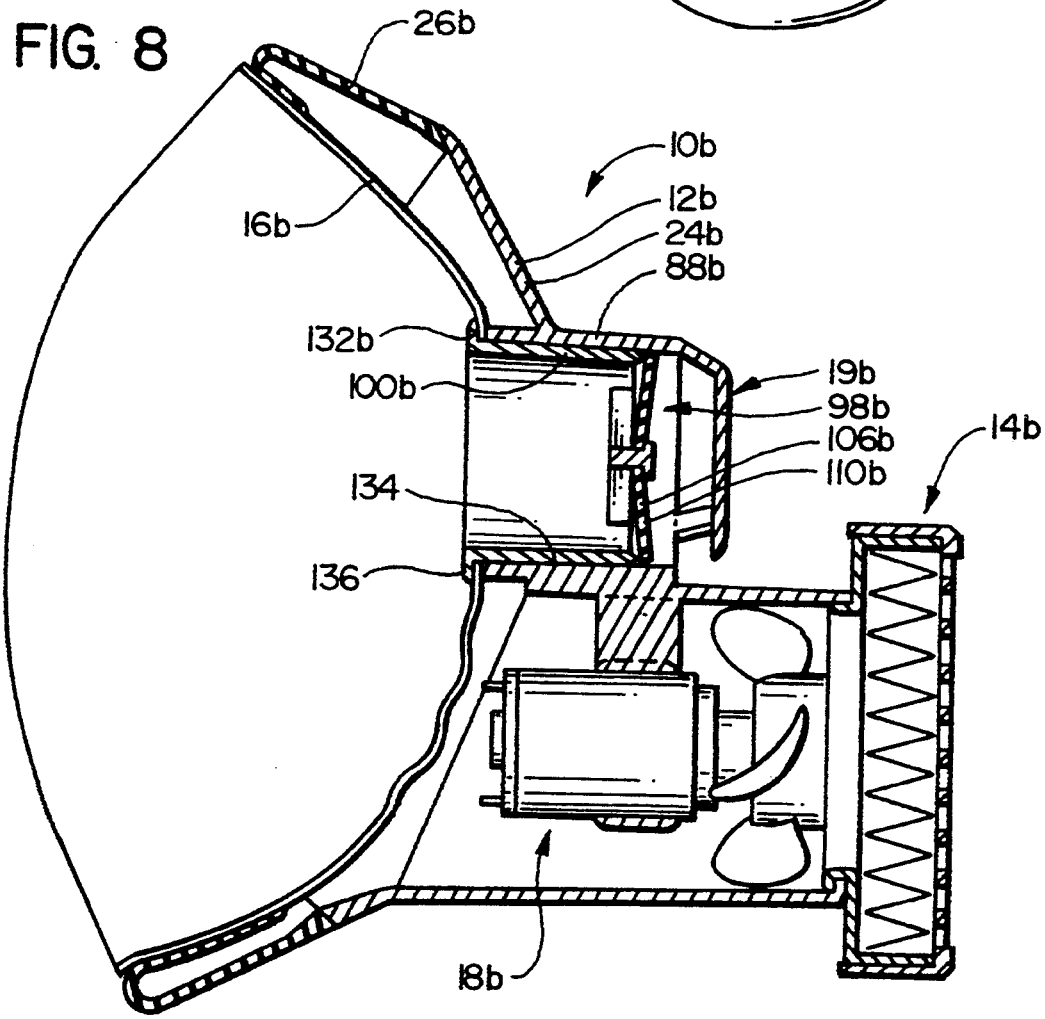
FIG. 8 is a view similar to FIG. 6, showing yet a third embodiment of the present invention.
Figure 9:
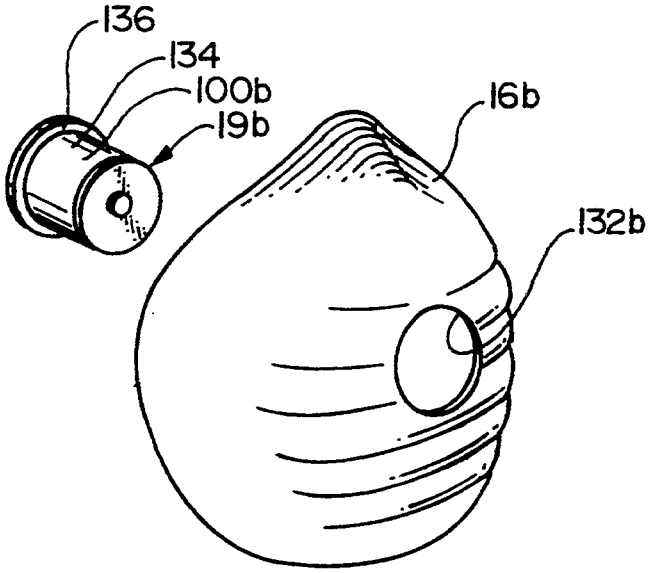
FIG. 9 is a view similar to FIG. 7, showing the replaceable inner filter and a retaining element incorporating a check valve therein.

A third embodiment of the present invention is illustrated In FIGS. 8 and 9. Components of this third embodiment which are similar to those of the first two embodiments will be given like numerical designations, with a "b" suffix distinguishing those of the third embodiment. This third embodiment is substantially identical to the second embodiment, except that the removeable mounting collar of the second embodiment is simply combined to be integral with the mounting cylinder 100*a* of the first embodiment as a single unit. Thus, the entire valve section 98*b* can be replaced, or removed to be sanitized and then be put back in place.

Thus, in this third embodiment, there is a mounting collar 134 having at its rear edge a peripheral lip 136 which engages the edge portion 132*b* of the inner filter 16*b*. This collar 134 extends forwardly to fit within the mounting cylinder 88*b*, and the check valve 106*b* is mounted to the forward end of a cylindrical collar 134.

Figure 12:
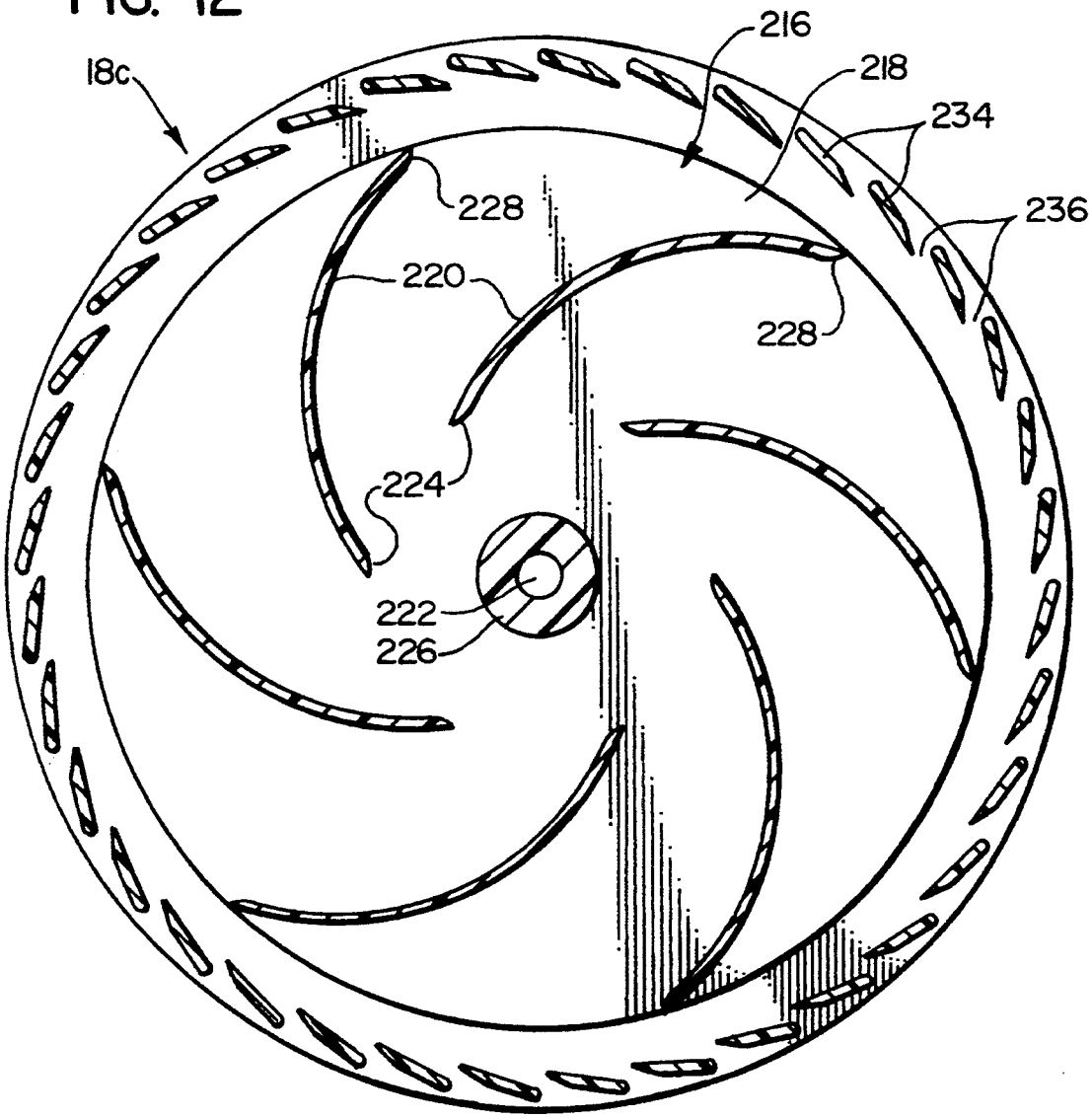
FIG. 12 is a sectional view taken along 12—12 of FIG. 11.

A fourth embodiment of the present invention is shown in FIGS. 10 through 12. Components of the fourth embodiment which are similar to those of the earlier embodiments will be given like numerical designations, with a "c" distinguishing those of the fourth embodiment.

In this fourth embodiment, the mask assembly 10*c* comprises the main housing 12*c*, inner replaceable filter 16*c* and an air outlet assembly 19*c* which are rather similar to the corresponding components of the earlier embodiment. However, the arrangement of the fan 18*c* and of the primary filter 14*c* is somewhat different.

With regard to the filter 14*c*, instead of having a single forward mounted primary filter 14, there are two side mounted filters 14*c*, each of which has a filter containing section 52*c* and a closure cap or plate 54*c*.

The two containing sections 52*c* are mounted to a "T" shaped housing section 200 having two cylindrical laterally extending arm sections 202 and a central rearwardly extending center section 204. The two containing sections 52*c* each have a cylindrical passageway defining sections 206 which in addition to defining a flow passageway 208 serve to mount the related containing section 52*c* to the housing arm portions 202. The central housing portion 204 fits in a forward cylindrical mounting section 210 of the fan housing 212.

The motor 42*c* is centrally mounted in the housing section 200 so that its center axis of rotation is longitudinally aligned in a forward to rear direction, and its output shaft 214 connects to a rotor 216 of the fan 18*c*. To describe the fan 18*c* more particularly, the rotor 216 (See FIG. 12) comprises a circular plate 218 to which a plurality of impellor vanes 220 are mounted symmetrically about a center axis 222. These impellor vanes 220 have inner end portions 224 which are spaced a short distance outwardly of a central hub 226, and from the end 224 the vanes 220 extend in a radially outward curve that slants in a direction that is more parallel with the circumference of the fan at outer ends 228 thereof.

The rotation of the rotor 216 causes the impellor vanes 220 to discharge air in a radially outward direction and draw air into the center area. The aforementioned center housing section 204 has a transverse wall 230 having a center opening 232 through which outside air flows into the fan 18*c* at a central location within the rotor 216. Then this air is moved radially outwardly in a somewhat swirling motion by the action of the rotation of the vanes 220 rotating with the rotor 216.

Around the perimeter of the fan 18*c*, there is a plurality of guide vanes 234, with each adjacent set of guide vanes 234 defining a related passageway or slot 236, these slots extending moderately outwardly with a tangential slant.

The basic operation of this fourth embodiment 10*c* is similar to the prior three embodiments, except for the overall configuration of the mask, particularly with regard to the two primary filter sections 14*c*, and also, the action of the fan 18*c* is somewhat different than in the prior embodiments.

With regard to the differences in the configuration, it will be noted that the two primary filter sections 14*c* are positioned so that these are located at a lower location, with the center housing section 204 extending downwardly and forwardly. Further, the two primary filter sections 14*c* are positioned further rearwardly so as to be more outside the normal field of vision of the person wearing the mask. By placing the filter sections 14*c* at side locations, there is less interference with the vision of the person when the person's line of vision is directed downwardly and forwardly as opposed to being directed off to one side.

With regard to the action of the fan 18*c*, the movement of the air is accomplished by the air being drawn in through the two filters 14*c*, through the opening 232 into the center part of the rotor 216, with the rotation of the vanes 220 then moving this air radially outwardly. The guide vanes 234 create a uniform flow of the air outwardly, and it is surmised that this arrangement reduces unnecessary turbulence in the airflow so that as the air flows into the plenum chamber 72*c* between the filter 16*c* and the housing 12*c*, the energy imparted to the incoming air is translated essentially to increased pressure of the air in the plenum 72*c*. Also, with this air being discharged from around the perimeter of the fan 18*c*, it tends to pressurize the entire plenum chamber 72*c* more effectively for more uniform flow through the filter 16*c*.

It is to be recognized that various modifications could be made in the present invention without departing from the basic teachings thereof.

What is claimed:

1. A face mask assembly to be worn by a person over a facial breathing area of the person, said mask assembly comprising:

a. a main housing;

a filter having an inner surface and an outer surface, and being mounted to said housing so that with the assembly being worn by the person, the filter is positioned so that the inner surface of the filter defines with the person's facial breathing area an air breathing region from which the person inhales air and into which the person exhales air, said filter being arranged to have outside air pass through the outer surface and from the inner surface into said air breathing region to be inhaled;

c. outlet check valve means communicating with said air breathing region to discharge exhaled air from said air breathing region, and to prevent outside air to pass through said check valve means into said air breathing region;

d. said filter being arranged so that with the assembly being worn by the person, the filter encloses at least a substantial portion of the air breathing region to provide substantial isolation of said air breathing region from said assembly, except for said check valve means;

e. said housing and the outer surface of said filter defining at least partially a plenum chamber from which air flows through said filter into said air breathing region;

f. fan means arranged to draw ambient air into said plenum chamber to flow through said filter; and g. said valve means comprises a valve element means and a valve mounting structure, said valve mouting structure extending through said filter.

2. The assembly as recited in claim 1, wherein said valve means defines a passageway by-passing said filter and leading from said air breathing region through said valve means to an area outside said mask assembly.

3. The assembly as recited in claim 1, wherein said filter has a perimeter portion positioned within a perimeter portion of said main housing, with the perimeter portion of the filter being positioned adjacent to the person's facial surface area with the mask assembly in its use position being worn by the person, said valve means being positioned within the perimeter portion of said housing and spaced therefrom.

4. The assembly as recited in claim 3, wherein a portion of said outlet check valve means which is exposed directly to said air breathing region is removably mounted so as to be readily removed and/or replaced in said face mask assembly.

5. The assembly as recited in claim 4, wherein said assembly further comprises an outer filter arranged to receive outside air which passes therethrough and into said plenum chamber.

6. The assembly as recited in claim 5, wherein said fan means is arranged to draw outside air through said outer filter which is then moved by said fan means into said plenum chamber.

7. The assembly as recited in claim 1, wherein a portion of said outlet check valve means which is exposed directly to said air breathing region is removably mounted in said main housing so as to be readily removed and/or replaced in said face mask assembly.

8. The assembly as recited in claim 1, wherein said assembly further comprises an outer filter arranged to receive outside air which passes therethrough and into said plenum chamber.

9. A face mask assembly to be worn by a person over a facial breathing area of the person, said mask assembly comprising:

a. a main housing;

b. an inner filter mounted to said housing so that with the assembly being worn by the person, the inner filter is positioned to define with the person's facial breathing area an air breathing region from which the person inhales air and into which the person exhales air, said inner filter being arranged to have outside air pass therethrough into said air breathing region to be inhaled;

c. said inner filter being arranged so that with the assembly being worn by the person, the inner filter encloses at least a substantial portion of the air breathing region;

d. said housing and said inner filter defining at least partially an intermediate plenum chamber from which air flows through said filter into said air breathing region;

e. fan means arranged to draw ambient air into said plenum chamber to flow through said filter;

f. an outer filter arranged to receive said ambient air which passes therethrough and into said plenum chamber; and g. outlet check valve means communicating with said air breathing region to discharge exhaled air from said air breathing region, and to prevent outside air to pass through said valve means into said air breathing region, said valve means comprising a valve element means and a valve mounting structure, said valve mounting structure extending through said inner filter.

10. The valve assembly as recited in claim 9, wherein said valve means defines a passageway by passing said inner filter and said outer filter, and leading from said air breathing region through said valve means to an area outside said mask assembly.

11. The assembly as recited in claim 10, wherein said inner filter has a perimeter portion positioned adjacent to a perimeter portion of said main housing, with the perimeter portion of the inner filter being positioned adjacent the person's facial surface area with the mask assembly in its use position being worn by the person.

12. The assembly as recited in claim 9, wherein said inner filter has a perimeter portion positioned adjacent to a perimeter portion of said main housing, with the perimeter portion of the inner filter being positioned adjacent the person's facial surface area with the mask assembly in its use position being worn by the person.

13. A method to filter air for a person who is breathing the air, said method comprising:

a. placing a replaceable filter in a main housing of a mask assembly in a manner so that with the assembly being worn by the person, the replaceable filter is positioned to define with the person's facial breathing area an air breathing region from which the person inhales air and into which the person exhales air, said filter being arranged so that with the assembly being worn by the person, the filter substantially encloses the air breathing region and isolates said air breathing region from said assembly;

b. also positioning said filter in said housing to define at least partially with said housing a plenum chamber from which air can flow through said filter into said air breathing region;

c. positioning fan means in said assembly and arranging said fan means to draw ambient air into said plenum chamber to flow through said filter;

d. placing said mask assembly over the person's facial breathing area to cause the replaceable filter to substantially enclose the person's facial breathing area;

e. operating said fan means to cause outside air to flow into said plenum chamber to pressurize said plenum chamber and cause the air to flow through the filter into the air breathing region; and f. providing outlet check valve means communicating with said air breathing region, and causing exhaled air to be discharged from said air breathing region through said valve means, and preventing outside air from passing through said valve means into said air breathing region, said method further comprising providing said valve means as a valve element means and a valve mounting structure, with said valve mounting structure engaging at least a portion of said filter so as to function to position said filter relative to said main housing to provide said plenum chamber.

14. The method as recited in claim 13, further comprising discharging exhaled air through a valve structure that defines a passageway bypassing said filter and leading from said air breathing region through and valve element means to an area outside said mask assembly

15. The method as recited in claim 13, further providing said filter with a perimeter portion positioned within a perimeter portion of said main housing, with the perimeter portion of the filter being positioned adjacent to the person's facial surface area with the mask assembly in its use position being worn by the person.

16. The method as recited in claim 13, further providing a portion of said outlet check valve means which is exposed directly to said air breathing region as a removably mounted portion in said main housing, and removing said portion of the check valve means from said face mask assembly.

17. The method as recited in claim 13, further comprising providing an outer filter to receive outside air which passes therethrough and into said plenum chamber.

18. The method as recited in claim 17, further providing positioning said fan means to draw outside air through said outer filter which is then moved by said fan means into said plenum chamber.

19. A face mask assembly to be worn by a person over a facial breathing area at a facial surface of the person, said mask assembly comprising:

a. a main housing;

b. a replaceable filter having an inner surface and an outer surface and being removably mounted to said housing so that with the assembly being worn by the person, the replaceable filter is positioned so that the inner surface of the replaceable filter defines with the person's facial breathing area an air breathing region from which the person inhales air and into which the person exhales air, said replaceable filter being arranged to have outside air pass through the outer surface and from the inner surface of the replaceable filter into said air breathing region to be inhales;

c. said replaceable filter having a perimeter portion and being arranged so that with the assembly being worn by the person, the replaceable filter substantially encloses the air breathing region, with the perimeter portion of the replaceable filter being adjacent to the facial surface of the person, and isolates said air breathing region from portions of said assembly outside of said outer surface of the replaceable filter;

d. said housing and the outer surface of said filter defining at least partially a plenum chamber which is separated from said air breathing region by said replaceable filter and from which air flows through said replaceable filter from said inner surface of the replaceable filter into said air breathing region;

e. fan means arranged to draw ambient air into said plenum chamber to flow through said filter;

said perimeter portion of the replaceable filter extending adjacent to a nose area of the facial surface of the person downwardly along opposite sides of a mouth of the person and adjacent a chin portion of the person, said housing having a perimeter housing portion extending adjacent to the perimeter portion of the replaceable filter at the facial surface of the person, with the perimeter portion of the filter being, when the mask assembly is worn by the person, positioned between the housing perimeter portion and the facial surface of the person.

20. The assembly as recited in claim 19, wherein said assembly further comprises an outer filter arranged to receive outside air which passes therethrough and into said plenum chamber.

21. A face mask assembly to be worn by a person over a facial breathing area at a facial surface of the person, said mask assembly comprising:

a. a main housing;

b. a replaceable filter having an inner surface and an outer surface and being removably mounted to said housing so that with the assembly being worn by the person, the replaceable filter is positioned so that the inner surface of the replaceable filter defines with the person's facial breathing area an air breathing region from which the person inhales air and into which the person exhales air, said replaceable filter being arranged to have outside air pass through the outer surface and from the inner surface of the replaceable filter into said air breathing region to be inhaled;

c. said replaceable filter having a perimeter portion and being arranged so that with the assembly being worn by the person, the replaceable filter substantially encloses the air breathing region, with the perimeter portion of the replaceable filter being adjacent to the facial surface of the person, and isolates said air breathing region from portions of said assembly outside of said outer surface of the replaceable filter;

d. said housing and the outer surface of said filter defining at least partially a plenum chamber which is separated from said air breathing region by said replaceable filter and from which air flows through said replaceable filter from said inner surface of the replaceable filter into said air breath region;

e. fan means arranged to draw ambient air into said plenum chamber to flow through said filter;

f. outlet check valve means communicating with said air breathing region to discharge exhaled air from said air breathing region, and to prevent outside air from passing through said valve means into said air breathing region, said valve means comprising a valve element means and a valve mounting structure, said valve mounting structure engaging at least a portion of said replaceable filter so as to function to position said replaceable filter relative to said main housing to provide said plenum chamber.

22. The assembly as recited in claim 21, wherein said valve mounting structure defines a passageway which bypasses said replaceable filter and said plenum, and leads from said air breathing region through said valve element means to an area outside said mask assembly.

23. The assembly as recited in claim 22, wherein a portion of said outlet check valve means which is exposed directly to said air breathing region is removably mounted so as to be readily removed and/or replaced in said face mask assembly.

24. The assembly as recited in claim 23, wherein said valve means extends through an opening in said replaceable filter.

25. The assembly as recited in claim 21, wherein a portion of said outlet check valve means which is exposed directly to said air breathing region is removably mounted in said main housing so as to be readily removable from said face mask assembly.

26. The assembly as recited in claim 21, wherein said valve means extends through an opening in said replaceable filter.

27. The assembly as recited in claim 21, wherein said assembly further comprises an outer filter arranged to receive outside air which passes therethrough and into said plenum chamber.

28. The assembly as recited in claim 27, wherein said valve means defines a passageway which bypasses said replaceable filter, said plenum chamber and said outer filter, and leads from said air breathing region to an area outside said mask assembly.

29. The assembly as recited in claim 27, wherein said fan means is arranged to draw outside air through said outer filter which air is then moved by said fan means into said plenum chamber.

30. A face mask assembly to be worn by a person over a facial breathing area at a facial surface of the person, said mask assembly comprising:

a. a main housing;

b. a replaceable filter having an inner surface and an outer surface and being removably mounted to said housing so that with the assembly being worn by the person, the replaceable filter is positioned so that the inner surface of the replaceable filter defines with the person's facial breathing area an air breathing region from which the person inhales air and into which the person exhales air, said replaceable filter being arranged to have outside air pass through the outer surface and from the inner surface of the replaceable filter into said air breathing region to be inhaled;

c. said replaceable filter having a perimeter portion and being arranged so that with the assembly being worn by the person, the replaceable filter substantially encloses the air breathing region, with the perimeter portion of the replaceable filter being adjacent to the facial surface of the person, and isolates said air breathing region from portions of said assembly outside of said outer surface of the replaceable filter;

d. said housing and the outer surface of said filter defining at least partially a plenum chamber which is separated from said air breathing region by said replaceable filter and from which air flows through said replaceable filter from said inner surface of the replaceable filter into said air breathing region;

e. fan means arranged to draw ambient air into said plenum chamber to flow through said filter;

f. outlet check valve means which extends from said air breathing region through said replaceable filter to discharge exhaled air from said air breathing region to an outside location, and to prevent outside air to pass through said valve means into said air breathing region, said outlet check valve means being positioned so that with the assembly being worn by the person, said check valve means is postioned forwardly and adjacent to a nose and mouth portion of the person's facial breathing area.

31. The assembly as recited in claim 30, further comprising an outer filter arranged to receive outside air which passes therethrough and into said plenum chamber, said fan means and said outer filter being positioned in said assembly lower than said outlet check valve means.

32. The assembly as recited in claim 31, wherein said outer filter is positioned forwardly of said fan means and beneath said check valve means.

33. The assembly as recited in claim 31, wherein said fan means is located below said check valve means, and said outer filter comprises two outer filter members laterally spaced on opposite sides of said check valve means.

34. The assembly as recited in claim 31, wherein said housing comprises a wall portion configured so that with the assembly being worn by the person, a peripheral portion of the wall portion of the housing has an upper end located adjacent to the person's nose area, a lower portion positioned adjacent to the person's chin area, and two side perimeter portions positioned adjacent to the person's cheeks on opposite sides of the person's mouth, the wall portion of the housing generally following a contour of the person's facial area and being spaced therefrom and also spaced from said replaceable filter so that the wall portion of the housing forms with adjacent portions of the replaceable filter a substantial portion of the plenum chamber.

35. The assembly as recited in claim 34, wherein said fan means comprises a fan housing defining a passageway to said plenum chamber, and said fan housing is positioned at a lower part of said plenum chamber.

36. The assembly as recited in claim 30, wherein said fan means comprises a rotor having impeller vane means which moves air in said fan means radially outwardly, and guide van means to receive air from said impeller van means to direct said air into said plenum chamber.

37. The assembly as recited in claim 36, wherein said rotor has an axis of rotation which extends in generally forward to rear direction, with said air being discharged from said guide vanes generally laterally around the perimeter of said fan means into said plenum chamber.

38. The assembly as recited in claim 37, wherein there is an outer filter which comprises two outer filter members which are arranged to receive ambient air with ambient air flowing through said outer filter members into said fan means.

39. The assembly as recited in claim 36, wherein there is an outer filter which comprises two outer filter members which are laterally spaced from said fan means on opposite sides of main housing.

* * * * *